United States Patent [19]

Hunter

[11] 4,425,056

[45] Jan. 10, 1984

[54] TENSION CONTROL SYSTEM FOR CONTROLLING THE TENSION IN PLATFORM SUPPORTING TENSION LEGS.

[75] Inventor: Andrew F. Hunter, Houston, Tex.

[73] Assignee: Conoco Inc., Ponca City, Okla.

[21] Appl. No.: 293,734

[22] Filed: Aug. 17, 1981

[51] Int. Cl.[3] ..... E02D 5/74

[52] U.S. Cl. ..... 405/224; 405/197

[58] Field of Search ..... 114/264, 265; 405/195, 405/196, 197, 225, 227, 224; 175/7, 27

[56] References Cited

U.S. PATENT DOCUMENTS 3,538,653 11/1970 Meckler .
3,796,017 3/1974 Meckler .
3,983,706 10/1976 Kalinowski .
3,996,755 12/1976 Kalinowski .
4,040,265 8/1977 Hellerman et al. .
4,114,393 9/1978 Engle et al. ..... 114/264
4,121,806 10/1978 Iato et al. ..... 175/27
4,195,950 4/1980 Goldman .
4,226,555 10/1980 Bourne et al. ..... 405/224

FOREIGN PATENT DOCUMENTS 2035240A 6/1980 United Kingdom .

*Primary Examiner*—Dennis L. Taylor
*Assistant Examiner*—John A. Gungor
*Attorney, Agent, or Firm*—A. Joe Reinert

[57] ABSTRACT

The present invention provides methods and apparatus for tension compensation in the tension legs used to moor a floating platform to the sea floor. The apparatus includes one or more hydraulic jacks, each having a cylinder coupled through a load block to a tension leg, and having a piston cooperating with a load block plug coupled to the floating platform. An accumulator supplies hydraulic fluid to the jacks to compensatingly adjust the relative position of the piston and cylinder to selectively maintain the tension loading of the tension leg.

21 Claims, 4 Drawing Figures

TENSION CONTROL SYSTEM FOR CONTROLLING THE TENSION IN PLATFORM SUPPORTING TENSION LEGS.

BACKGROUND OF THE INVENTION

1. Field of the Invention

This invention relates broadly to tension leg platforms for offshore production and drilling, and more particularly, to an apparatus and method for compensating for undesirable changes in the tension loading of tension legs used to moor such platforms to the sea floor.

2. Description of the Prior Art

The following statement is intended to be a prior art statement in compliance with the guidance and requirements of 37 C.F.R. §§1.56, 1.97 and 1.98. In the exploration and production of hydrocarbons from a subsea formation, problems of weight and expense are encountered in very deep drilling and production activities which render the use of bottom-founded steel or concrete supporting structures less than optimum, and in some cases prohibitive. It is more economical to provide a semi-permanent site for producing and drilling operations in deep water by using a floating platform which is moored or tethered to anchor points on the sea floor, using vertical tension legs to moor the platform above the drilling or production sites. Such an assembly is known as a tension leg platform.

The use of pretensioned mooring legs prevents vertical motion or heave of the platform during wave passage, yet permits lateral deflection of the entire assembly. Leg pretensioning is accomplished by deballasting the floating platform after the tension legs have been connected to the sea floor anchor points. Such pretensioning prevents the tension legs from becoming slack during the passage of the troughs of most waves associated with even extreme environmental conditions.

After a tension leg platform has been constructed and the tension legs pretensioned by deballasting the platform, certain conditions can arise over the life of the structure which severely impair its usefulness and constitute possible extreme hazards to not only the drilling or production operation, but to the safety of the personnel on the platform. Unless the sea floor anchor foundations to which the tension legs are connected are positioned extremely accurately during construction of the platform, the pretension in the several tension legs will vary from leg to leg, causing possible overstressing of one of the legs as continuing wave action acts on the platform.

A more serious concern is that which is posed by the possibility of severe hurricane or cyclonic storm conditions which may generate giant waves at the locale of the tension leg platform. On such an occasion, the trough of such a giant wave will develop a slacked tether condition in which one or more of the tension legs is slacked and thus can collapse under its own weight. This condition is aggravated where the anchor foundations on the sea floor to which the tension legs are attached have been to any extent mispositioned. Moreover, even should the tension legs not collapse in the described slack tether condition, the following wave crest may suddenly restore an over-tensioned condition to one or more of the tension legs, tending to crack or pop them similarly to a whip, with immediate structural failure.

U.S. Pat. No. 3,983,706 to Kalinowski is directed to improvements in one type of tension cable offshore platform structure, such improvements residing in the ability to hydraulically tension and realign a vertical riser extending from the wellhead to the floating drilling platform. In order to compensate for the deflection of the riser from a vertical position under the impress of subsurface currents, or due to shifting of the floating platform in heavy seas, a plurality of hydraulic piston and cylinder assemblies are extended between the vertical riser and a plurality of tension cables spaced around the riser and connected between peripheral points of the platform and anchor blocks secured to the floor of the sea. Control of the hydraulic cylinders so as to compensate for positional shifting of the riser is accomplished from the floor of the platform by hydraulic conduits extended down along the side of the riser to the piston and cylinder assemblies. The structure described in the Kalinowski patent is not concerned with compensating for tension in the flexible tension cables used to moor the floating drilling platform depicted and described in that patent, and in fact there is no disclosure of any means for making any vertical adjustment in the relative positions of the floating platform and the upper portion tension legs in order to compensate for a slack tether condition resulting from an excessive wave troughing condition.

Another tension cable supported floating platform is illustrated and described in Engle, Jr. et al U.S. Pat. No. 4,114,393. The Engle patent is directed to an improvement in such platforms which damps the tension cables by interconnecting them at certain selected points so as to prevent resonant fluttering of the cables at certain flutter frequencies likely to be encountered, thus increasing the useful life of the cables. This structure, of course, experiences problems and considerations differing from tension leg platforms which employ tension legs formed by interconnected rigid tubular sections extended from anchor points to the platform, and pretensioned by deballasting of the platform.

Hydraulic jacks have been employed for aiding in extending the life of the support legs used in another type of offshore drilling platform called a jack-up rig. In these rigs, the platform is actually elevated above the surface of the ocean by a jacking action which extends the legs vertically during installation of the rig. With rigs of this type, problems arise from the severe shock forces to which the drilling rigs are subjected when they are placed upon or taken off of the ocean floor. This is due to the subjection of the platform at this time to forces tending to shift or move it and lift it up or down due to wave and current action, with the relatively stiff supporting legs then being subjected to sudden compressive loading and consequent damage. In U.S. Pat. No. 4,195,950, it is proposed to provide a shock-absorbing structure to be mounted on the bottom of each of the platform-supporting legs, utilizing hydraulic jacks at this location and associated compression members which surround the piston elements of the jacks so that such compression members absorb the shocks which would otherwise be transmitted directly to the legs during severe conditions at the rig location.

In United Kingdom Patent Application No. 2,035,240A filed on Nov. 14, 1979, a tether assembly for a tethered buoyant offshore platform is described. Hydraulic jacks are provided on the platform for pretensioning the tether shafts employed to moor the platform to the sea floor. After this time adjustments in the tension loading of the tether shafts is achieved primarily by shims. Some further adjustment in tether tension and also in tether length is achieved mechanically by the use of tether length adjustors, and also by hydraulic jacks which can be connected to the upper ends of the tether shafts by cables or a make-up piece. No arrangement is provided for automatically tensioning the tether shafts to compensate for an approach to a slack tether condition induced by extreme weather conditions.

SUMMARY OF THE INVENTION

The present invention provides a method and apparatus for automatically compensating for sea wave-induced tension reduction in the tension legs of a floating drilling platform moored by tension legs to the sea floor. The apparatus includes a load block coupled to each tension leg, and detachably connected to one or more hydraulic cylinders of a corresponding number of hydraulic jacks. The jacks are supplied with hydraulic power fluid at a preselected pressure developed by an accumulator. The jack cylinders each contain piston elements slidingly responsive to hydraulic fluid introduced to the respective cylinder, and cooperating with load plugs supported on load cells mounted on the floating platform for movement of both the load plug and load cells with the platform. The pressure in the accumulator is preset or is periodically adjusted to cause the jack cylinders and interconnected load blocks to move upwardly relative to the platform to keep a desired tension loading on the tension legs at times when the platform descends into a wave trough, thereby tending to induce a slacked condition in the tension legs.

It is, therefore, a general object of the invention to provide an improved method of fitting out and using tethered or moored offshore platforms.

A more specific object of the invention is to improve the safety with which wells can be drilled and hydrocarbons produced from offshore locations by means of tension leg platforms.

Another object of the invention is to provide a tethered floating platform anchored to the ocean floor by tension legs which are always loaded in tension to a safe degree so as to avoid structural failure thereof.

Yet another object of the invention is to provide a system which is useful in automatically maintaining tension in the tension legs of a tension leg platform under variant and extreme weather conditions.

Another object of the invention is to provide a pneumohydraulic system of simple and relatively inexpensive construction which can be incorporated without difficulty into existing tension leg platforms, and then function to protect the platform from structural failure due to a slack tether condition created by storm waves.

Additional objects, features and advantages of the present invention will be readily apparent to those skilled in the art from a reading of the description of a preferred embodiment of the invention when taken in conjunction with the accompanying drawings.

DETAILED DESCRIPTION OF A PREFERRED EMBODIMENT OF THE INVENTION

Figure 1:
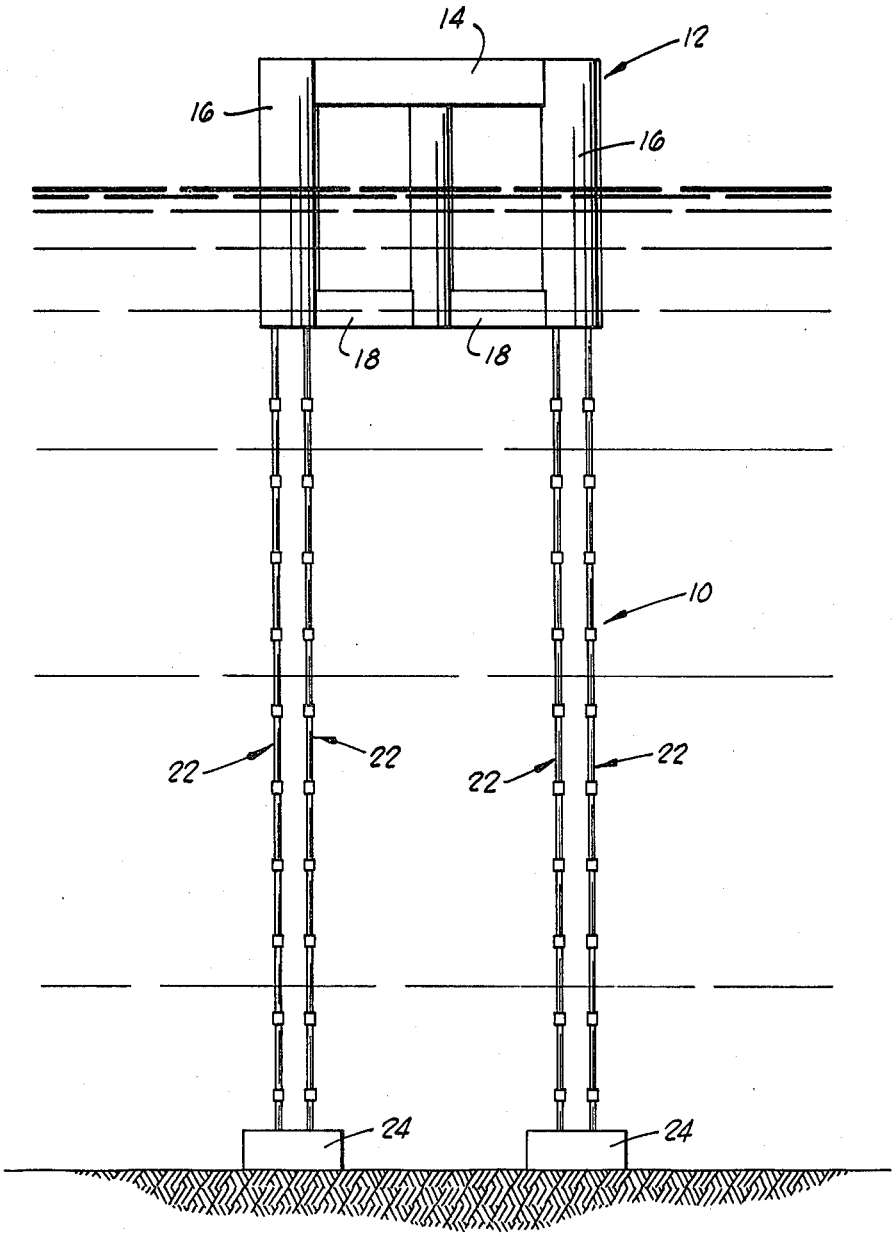
FIG. 1 is an elevational schematic view showing a floating, tether leg anchored platform in place over a sea floor anchor means.

Referring to the drawings, and particularly to FIG. 1, a tension leg mooring system which incorporates the present apparatus for compensating for the tension loading in the tension leg is shown, and is generally designated by the numeral 10. A tension leg platform 12 includes a deck portion 14, six vertical cylindrical sections 16 and lower horizontal pontoon portions 18 interconnecting the lower ends of the vertical, cylindrical sections 16.

The tension leg platform 12 is retained in operative position over the sea floor by vertical tension legs 22 which are attached at their lower ends to a number of sea floor anchor templates 24.

Figure 2:
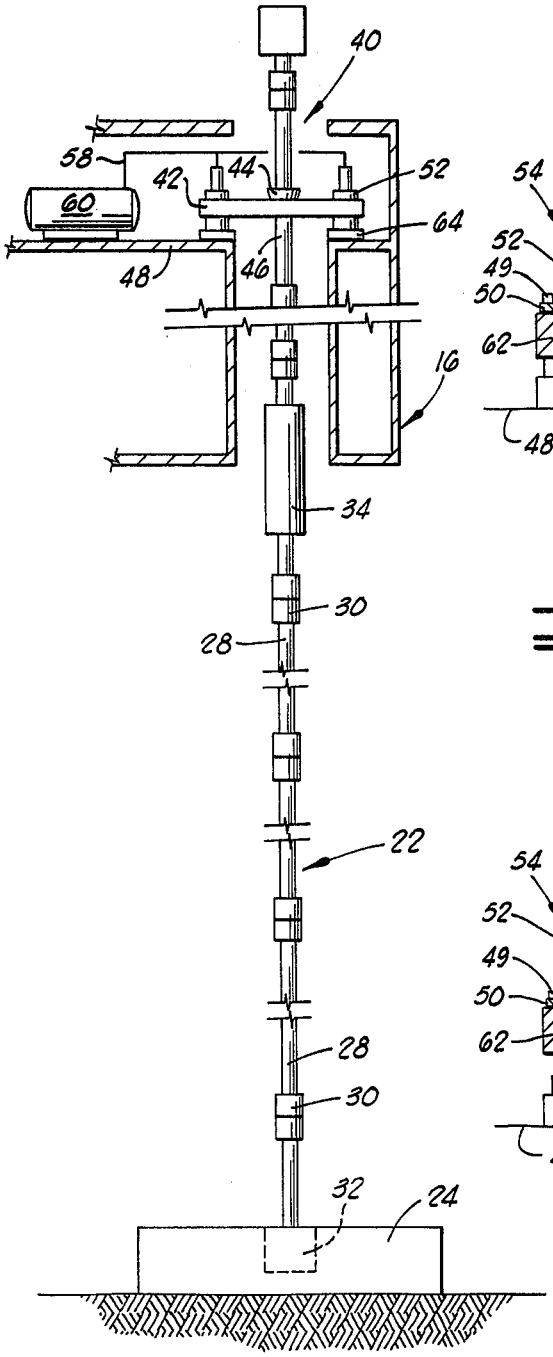
FIG. 2 is an elevational sectional view of a portion of the floating platform, a tension leg, a sea floor anchor means and the tension control system of the present invention.

The details of construction of each tension leg 22 and sea floor anchor template 24, and the manner in which each tension leg is extended between one of such templates and the platform 12, are best illustrated in FIG. 2 of the drawings. Thus, as there shown, each of the tension legs 22 includes a plurality of steel tension leg elements 28 interconnected at pin and box joints 30. Each tension leg 22 is connected to one of the sea floor anchor templates 24 by an inset anchor connector 32. A cross head bearing and flex joint 34 is interposed in each tension leg to accommodate various lateral motions of the platform 12.

The upper tension leg element 28 within each of the tension legs 22 is connected to a hanger means 40. The hanger means 40 is supported by a load block 42. In addition to the load block 42, the tension control system used for controlling the tension in each platform supporting tension leg 22 includes a wedge plug 44 or other suitable device for interconnecting the hanger means 40 to the load block so that an elongated rod 46 forming a portion of the hanger means will be gripped more tightly as an upward force is applied to the load block 42 relative to the tension leg 22. It will be perceived that the rod 46 constitutes a vertically extending tension load path extension means by which the tension load in the tension leg is transmitted to the load block.

Each load block 42 extends radially and horizontally from the respective tension leg 22 to which it is coupled by the wedge plug 44 and projects at its outer peripheral edge over a horizontal supporting plate 48 formed within, and constituting a part of, the respective vertical cylindrical section 16 of the platform through which the rod 46 extends. Near its outer periphery, the load block 42 is secured by suitable bolts 49 to horizontal flanges 50 carried at the lower ends of a hydraulic cylinder 52. The cylinder 52 is thus interconnected to the load block 42 for common movement therewith. Cylinder 52 is a part of a hydraulic jack subassembly designated generally by reference numeral 54. A plurality of the subassemblies is provided at spaced points located around each of the tension legs 22.

Each of the hydraulic jack subassemblies 54 further includes a floating piston element 56 which is slidably and reciprocably mounted within the respective hydraulic cylinder 52. A hydraulic power fluid is supplied to the closed upper end of each of the cylinders 52 in the jack subassemblies by means of a suitable conduit 58 which functions to convey fluid to the respective cylinder from an accumulator 60. The accumulator 60 is of conventional construction, and functions to contain, in the lower end thereof, an adequate reserve supply of a hydraulic power fluid, such as oil, and to enclose a volume of air within the upper end thereof above the hydraulic power fluid.

The tension control system of the invention further includes load block plugs 62 associated with each of the hydraulic jack subassemblies 54. Each load block plug 62 projects upwardly through a bore 63 of complementary configuration formed through the load block 42 and is in vertical alignment with a piston element 56 of one of jack subassemblies 54. The upper end of each load block plug 62 terminates at a location within the cylinder 52 contiguous to the lower end of the respective piston element 56, and each of such plugs is slidably received in its respective bore through the load block 42.

The lower end of each load block plug 62 is secured to, or formed integrally with, a relatively large base flange 64. Each of the base flanges 64 rests upon, and is force-coupled to, a load cell 66 by which the tension force in the respective tension leg engaged by the load block 42 can at all times be monitored. The load cells 66 rest upon the horizontal plate 48 secured within the respective vertical cylindrical section 16 forming a part of the tension leg platform 12.

The operation and utilization of the tension control system of the invention begins after the tension leg platform has beem moored over the drilling site. As previously explained, and as is understood in the art, the tension leg platform is installed by first interconnecting the tension legs 22 with the platform 12 prior to the time that the platform is deballasted. Deballasting the platform causes the several legs 22 to be placed in tension due to the increased buoyancy of the platform, and the mooring function of the tension legs then becomes effective.

Figure 3A:
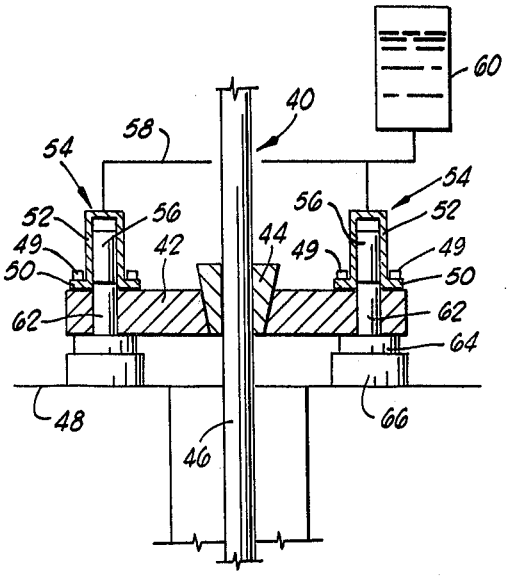
FIG. 3A is a partially schematic, partially sectional view of the tension control system of the present invention showing the system in a passive state.

When the tension control system of the present invention is incorporated in a moored tension leg platform in the manner shown in FIGS. 2 and 3A of the drawings, at this time, the tension load in respective tension legs 22 is transferred through the wedge plug 44, load block 42, cylinders 52, piston rods 46 and load block plugs 62 to the several load cells 66. It will be noted that as the tension leg platform rises relative to the sea floor in response to wave action, and more specifically to the passage of wave crests across the drilling situs, the tension of the several tension legs will be increased, and this increased loading will evoke a responsive correlative indication from the several load cells 66. Conversely, the passage across the drilling site of wave troughs "drops" the tension leg platform relative to the sea floor, decreasing the tension loading in the several tension legs 22. It is necessary at these times to provide in advance for the accommodation of this reduction in the tension loading of the legs by providing sufficient original pretensioning of the legs during the deballasting of the platform that the legs do not become slack, or become subjected to an excessive compressional load.

Under normal weather conditions, preselected tension forces initially imparted to the several tension legs 22 will be adequate to accommodate the rise and fall of the platform 12 resulting from wave action without excessively stressing the tension legs, or allowing development of a slack tether condition which is of a magnitude such that the legs will be buckled or structurally damaged. A problem not addressed by conventional pretensioning systems, however, is the rare, yet ultimately certain, condition occurring during cyclonic storms when high winds develop waves occasionally having an amplitude (distance from crest to trough) of almost 100 feet. In such eventuality, the conventional pretensioning which becomes effective at the time of original construction of the tension leg platform will not prevent the development of a slack tether condition under which substantially all tension is lost from the tension legs, and a significant danger of buckling and structural failure occurs.

The tension control system of the present invention provides an effective and workable safeguard against a slack tether condition buckling or severely damaging the tension legs. Initially, a reduction in the tension in the several tension legs 22, as indicated by readouts from the load cells 66, is determined or calculated which will represent a threshold value below which inadequate tensioning of the legs is existent, and substantial danger of buckling or structural failure exists. The tension control system is then energized by raising the pressure of the air in the accumulator 60 to a desired level which is at or above the critical tension force determined to be that below which danger of buckling of the tension legs exists. The tension control system can thus be made to automatically respond to drastic decreases in tension in the legs 22 to provide instant compensation which maintains the legs in tension, despite a wave troughing condition which tends dangerously toward the development of a slack tether condition.

In the operation of the system, the accumulator pressure acts via the oil or other hydraulic fluid on the upper end of the piston elements 56 mounted within the cylinders 52 of the several hydraulic jack subassemblies 54. The pressure thus developed constantly tends to move the cylinders 52 upwardly with respect to the respective piston elements 56. This upwardly acting force is opposed by the force applied to, and acting downwardly upon the cylinders 52 as a result of the transference of the tension leg load through the wedge plugs 44 and load blocks 42 to the several cylinders 52 which are bolted to the respective load blocks.

It will be apparent that at such time as the tension load acting to prevent the cylinders 52 from moving upwardly relative to their respective piston elements 56 drops below the force resulting from the application of hydraulic pressure to the top of the several pistons 56 by the oil from the accumulator, the cylinders 52 will move upwardly relative to the piston elements 56 until the balance of forces is restored. This will, of course, occur when the tension load is increased to equal the value of the force resulting from accumulator pressure. For a given hydraulic jack size, the pressure area of the piston element is constant, and therefore the load applied as the result of accumulator pressure is a linear function of this pressure. Thus, for example, 3,000 psi accumulator pressure may yield 1,500 tons of tension, and 1,000 psi accumulator pressure will, in such case, provide 500 tons of tension.

Figure 3B:
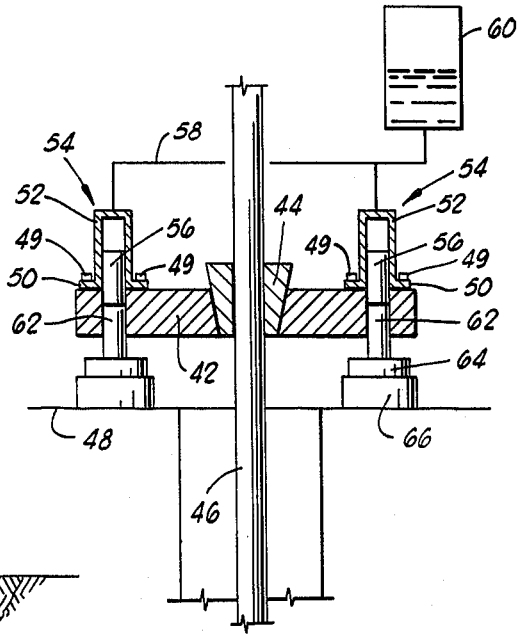
FIG. 3B is a view similar to FIG. 3A, but illustrating the tension control system in an active state.

It will be seen from the foregoing description that once the system has been energized, it remains passive (in one mode of utilization and operation) until the tether tensions existent in the several tension legs fall to a certain predetermined value considered to indicate an undesirably dangerous reduction in tension. At this point, the tension-compensating forces exerted on the several hydraulic jack subassemblies 54 by the accumulator 60 will cause the load blocks and associated cylinders to rise in relation to the load block plugs 52, thus maintaining safe tensioning of the several tension legs. The active status of the system under which such compensating effect has occurred, and the load block and associated cylinders have moved upwardly relative to the load block plugs 62, load cells 66 and horizontal plate 48 is shown in FIG. 3B of the drawings.

To utilize the system of the invention for basic tether pretensioning adjustments, in addition to its principal use as a compensation system safeguarding against a slack tether condition, it is merely required to select and use larger hydraulic jacks. The system can also be used to fine-tune or adjust the tension in individual tension legs to optimize overall balance in tether loads imposed on the tension legs.

A cyclic reversal of tension leg loading resulting after the passage of the storm wave trough, and the response of the platform to ensuring wave crest passage will react against the hydraulic jack loading from the accumulators, bringing the load block back to its original position, and forcing the hydraulic fluid back into the accumulator. This reverse jacking action, by reason of the inherent characteristic of air-containing accumulators, will provide adequate cushioning of the load block/plug seating.

In some instances, it may be desirable to de-energize this system when weather conditions impose no concern for dangerous wave activity. In such case, de-energization can be easily accomplished by merely releasing the pressure from the accumulator.

The tension control system of the invention provides a number of advantages and is quite flexible in its utility. As previously pointed out, with suitably sized jacks, incremental adjustments to the basic pretension developed in the tension legs can be selectively made as may be needed or desired. With respect to extreme wave action tending, upon troughing, to develop a slack tether condition resulting in buckling of the tension legs, the system can be energized for any desired minimum tension response, and in many cases, this will mean that it is easily adaptable to any size of platform developing any degree of buoyancy upon deballasting. The system is also useful in providing such selective tension adjustments to individual legs as may be needed in damage control functions where it is required to either flood or deballast one or more water-tight compartments on the platform.

It should be noted that should it be desired from time to time to inspect parts of the tension control system, the structure employed lends itself to such inspection. This is accomplished by unbolting the cylinders 52 from the load block 42, thus exposing the piston elements 56 for repair or replacement. Piston elements 56 can themselves be removed from their respective cylinders 52 after these have been unbolted from the load block 42 without the necessity for disturbing or removing the load block plugs 62 or the load cells 66 upon which they are supported. Neither must the load block 42 be decoupled from the respective tension leg to which it is connected by means of the wedge plug 44.

Although certain preferred embodiments of the invention have been therein described in order to illustrate the basic principles which underlie the invention, it will be understood that various changes and innovations in the described and illustrated system can be effected without departure from these basic principles. Changes and innovations of this type are therefore deemed to be circumscribed by the spirit and scope of the invention, except as the same may be necessarily limited by the appended claims for reasonable equivalents thereof.

What is claimed is:

1. Apparatus for compensating for changes of the tension in a tension leg used to moor a floating platform to the sea floor comprising:

a hydraulic jack including a cylinder and a floating piston movably contained in the cylinder;

a load block connected to the cylinder and adapted to be coupled to the tension leg;

a load block plug projecting slidably through a bore of said load block and having an upper end freely abutting a lower end of said floating piston for movement therewith relative to such cylinder, said load block plug being fixedly connected to said floating platform, said bore of said load block being aligned with a bore of said cylinder; and an accumulator connected to the cylinder for supplying hydraulic fluid, under pressure, to said cylinder over said floating piston to thereby selectively maintain the tension loading of the tension leg.

2. An apparatus as defined in claim 1 and further characterized as including a wedge plug contacting the load block and adapted to surround the tension leg and couple the tension leg to the load block.

3. An apparatus as defined in claim 1 and further characterized as including a load cell positioned beneath the load block plug for transmitting tension load from the tension leg through the load block to the platform via compressional loading of the load cell.

4. An apparatus as defined in claim 1 and further characterized as including:

a horizontally extending flange secured to the hydraulic jack cylinder; and bolt means bolting the flange to the load block, so that said cylinder can be detached from said load blocks and said floating piston can be removed and repaired while said load block is held in place by said load block plugs.

5. An apparatus as defined in claim 1 wherein the load block is a horizontally extending rigid block having an outer peripheral portion extending under said hydraulic jack cylinder.

6. An apparatus as defined in claim 1 wherein said floating piston is reciprocably movable in a vertical direction of movement within said jack cylinder and said load block is connected to said jack cylinder for reciprocating movement of said load block with said cylinder relative to said floating piston.

7. An apparatus as defined in claim 1 wherein the load block is a horizontally extending rigid block having a central opening therethrough adapted to receive tension load path means coupled to the tension leg and in vertical alignment therewith; and wherein a plurality of said hydraulic jacks are provided and are operatively connected to said load block through their respective cylinders at horizontally spaced locations around said central opening.

8. An apparatus as defined in claim 1 wherein said accumulator is a pre-set accumulator delivering hydraulic fluid to said jack cylinder at a pre-selected constant pressure.

9. An apparatus as defined in claim 1 wherein said accumulator is further characterized as including a confining chamber containing a hydraulic liquid and a compressible fluid functioning to cushion the retraction of said floating piston into said cylinder upon termination of the tension compensation action of said apparatus.

10. An apparatus as defined in claim 1 wherein said load block extends horizontally and said apparatus further includes a base flange extending beneath said load block for supporting said load block when said compensating apparatus is not compensating, and having said load plug secured thereto and projecting upwardly therefrom in vertical alignment with said floating piston.

11. An apparatus as defined in claim 3 and further characterized as including:

flange means secured to the hydraulic jack cylinder; and means securing the flange means to the load block to assure mutual movement of the cylinder and load block.

12. An apparatus as defined in claim 3 wherein the load block is a horizontally extending rigid block having an outer peripheral portion extending under said hydraulic jack cylinder.

13. An apparatus as defined in claim 3 wherein said accumulator is a pre-set accumulator delivering hydraulic fluid to said jack cylinder at a pre-selected constant pressure.

14. An apparatus as defined in claim 8 wherein said accumulator is further characterized as including a confining chamber containing a hydraulic liquid and a compressible fluid functioning to cushion the retraction of said floating piston into said cylinder upon termination of the tension compensation action of said apparatus.

15. An apparatus as defined in claim 10 and further characterized as including a load cell positioned beneath the base flange for transmitting tension loads from the tension leg through the load block to the platform via compressional loading of the load cell.

16. An apparatus as defined in claim 15 wherein said accumulator is a pre-set accumulator delivering hydraulic fluid to said jack cylinder at a pre-selected constant pressure.

17. A tether leg tensioning device useful in preventing loss of tension loading in a tether leg used to moor an offshore tethered platform comprising:

rigid tension load path extension means connectable to the tether leg and projecting along a vertical axis;

rigid load block means connected to the extension means and projecting radially and horizontally outwardly from said vertical axis for redirecting the tension load horizontally;

jack means connected to the load block means and including a piston part and cylinder part movable relative to each other and having one of said piston part and said cylinder part connected to said load block means and synchronously movable therewith;

compressional load transmitting means associated with said jack means for transmitting a compression load from said jack means to the tethered platform, said compressible load transmitting means including:

a load cell adapted to be interposed in the compression load path between said jack means and said platform; and load plug means resting on said load cell and engaged by said jack means;

means responsive to a reduction in the tension load in said extension means to actuate said jack means to apply a vertically acting tension compensating force to said load block means; and wherein said jack means comprises a hydraulic cylinder secured to said load block means for movement therewith and an extensible piston reciprocably mounted in said cylinder and extending into contact with said load plug means.

18. An apparatus as defined in claim 17 wherein said actuating means comprises:

a source of pressurized fluid; and means for conveying said pressurized fluid to said jack means.

19. A method for automatically compensating for a decrease in the tension loading of a tension leg used to moor an offshore platform to the sea floor comprising:

coupling hydraulic jack means between the tension leg and the platform so that charging hydraulic fluid to the jack means tends to move the tension leg relative to the platform; and connecting an accumulator containing gas-pressurized hydraulic fluid to the jack means to continuously supply hydraulic fluid to the jack means at a pressure at least sufficient to maintain the minimum tension load that the design of the offshore platform requires to be maintained in the leg; wherein said jack means is coupled between the tension leg and the platform by: coverting the tension load to a compressional load acting on said hydraulic jacks; then making a part of said jack means connected to said tension leg movable in a direction opposing said compressional load to increase the tension in said tension leg.

20. The method as defined in claim 19 and further characterized as including the step of placing load cell means between said jack means and platform and in the load path by which the tension loading in said leg is transferred to said platform to continuously monitor the tension loading in said tension leg.

21. A method for automatically compensating for tension changes in a tension leg used to moor an offshore platform to the sea floor comprising:

coupling pressure responsive jack means directly in the force load path between the tension leg and the platform; and selectively and periodically pressurizing the jack means to actuate the jack means to a directional movement opposing reductions in the tension load in the tension leg, wherein said selective, periodic pressurizing is automatically effected upon the occurrence of tension load reductions of a predetermined magnitude in the tension leg.

* * * * *